US006324340B1

(12) United States Patent
Kim

(10) Patent No.: US 6,324,340 B1
(45) Date of Patent: Nov. 27, 2001

(54) COMBINED ELECTRIC FAN AND RADIATION HEATER

(76) Inventor: Man Won Kim, 103-101 Samhan Apt., 78-1 Hyosung 1-dong, Gyeyang-gu, Inchon (KR)

( * ) Notice: Subject to any disclaimer, the term of this patent is extended or adjusted under 35 U.S.C. 154(b) by 0 days.

(21) Appl. No.: 09/701,293

(22) PCT Filed: Mar. 29, 2000

(86) PCT No.: PCT/KR00/00276

§ 371 Date: Nov. 28, 2000

§ 102(e) Date: Nov. 28, 2000

(87) PCT Pub. No.: WO00/58669

PCT Pub. Date: Oct. 5, 2000

(51) Int. Cl.[7] ..... F24H 3/00
(52) U.S. Cl. ..... 392/361; 416/247 R; 416/146 R
(58) Field of Search ..... 392/361; 416/247 R, 416/95, 146 R

(56) References Cited

U.S. PATENT DOCUMENTS 1,453,873 * 5/1923 Hicks ..... 416/146 R
1,840,918 * 1/1932 Seale ..... 392/361
2,334,501 * 11/1943 Moeller ..... 392/361
3,446,429 * 5/1969 Suzuki et al. ..... 416/247 R

* cited by examiner

*Primary Examiner*—John A. Jeffery
(74) *Attorney, Agent, or Firm*—Staas & Halsey LLP

(57) ABSTRACT

A combined electric fan and radiation heater, selectively used as an electric fan in summer and as an electric radiation heater in winter, is disclosed. The combined fan and heater of this invention consists of a fan motor set in a motor case, a parabolic rear safety net, a blade unit, and a parabolic front safety net in the same manner as a conventional electric fan. The combined fan and heater is also provided with a parabolic reflector and a heat radiating body. The parabolic reflector is designed to be detachably attached to the front end surface of the motor case using a nut while replacing the rear safety net. The heat radiating body is externally wound with a heating coil and is designed to be detachably held on a seat of the parabolic reflector prior to being attached to the front end surface of the motor case using a plurality of locking screws while replacing the blade unit, with the heating coil being operated in conjunction with an existing electric circuit. When the combined fan and heater is used as an electric radiation heater, the heater accomplishes a desired radiation heating effect, allowing strong heat to effectively reach an area considerably remote from the heater, due to the parabolic reflector.

1 Claim, 4 Drawing Sheets

COMBINED ELECTRIC FAN AND RADIATION HEATER

TECHNICAL FIELD

The present invention relates, in general, to electric equipment and, more particularly, to a combined electric fan and radiation heater designed to be selectively used as an electric fan in summer and as an electric radiation heater in winter.

BACKGROUND ART

Conventional electric fans are seasonal equipment only used in summer, and so they are necessarily stored out of season while consuming space and being inconvenient to users. Such a problem is also experienced in conventional electric heaters, or the seasonal equipment only used in winter.

Therefore, it is desired to propose a combined electric fan and radiation heater, which is selectively usable as an electric fan in summer and as an electric heater in winter and is thus not necessary to be stored out of season.

DISCLOSURE OF THE INVENTION

Accordingly, the present invention has been made keeping in mind the above problems occurring in the prior art, and an object of the present invention is to provide a combined electric heater and fan, which is designed to be selectively used as an electric fan in summer and as an electric radiation heater in winter while substituting both a blade unit and a rear safety net of the fan with a heat radiating body and a parabolic reflector of the heater.

In order to accomplish the above object, the present invention provides a combined electric fan and radiation heater, comprising a fan motor set in a motor case, a parabolic rear safety net, a blade unit, and a parabolic front safety net, further comprising a parabolic reflector designed to be detachably attached to the front end surface of the motor case using a nut while replacing the rear safety net, and a heat radiating body externally wound with a heating coil and designed to be detachably held on a seat of the parabolic reflector prior to being attached to the front end surface of the motor case using a plurality of locking screws while replacing the blade unit, with the heating coil being operated in conjunction with an existing electric circuit.

When the combined fan and heater is used as an electric radiation heater, the heater accomplishes a desired radiation heating effect, allowing strong heat to effectively reach an area considerably remote from the heater, due to the parabolic reflector.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
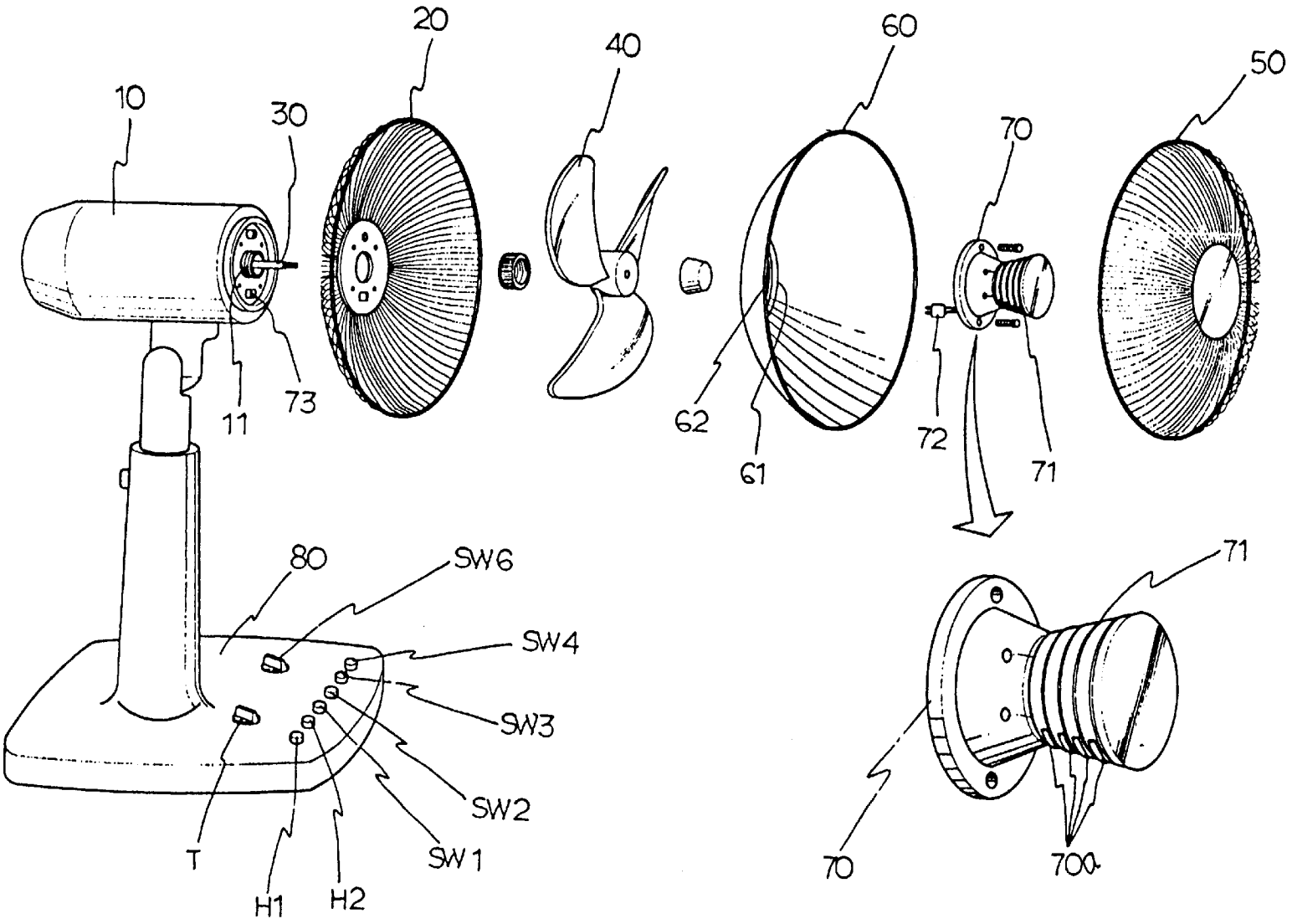
FIG. 1 is a partially exploded perspective view, showing the construction of a combined fan and heater in accordance with the preferred embodiment of the present invention.
Figure 2:
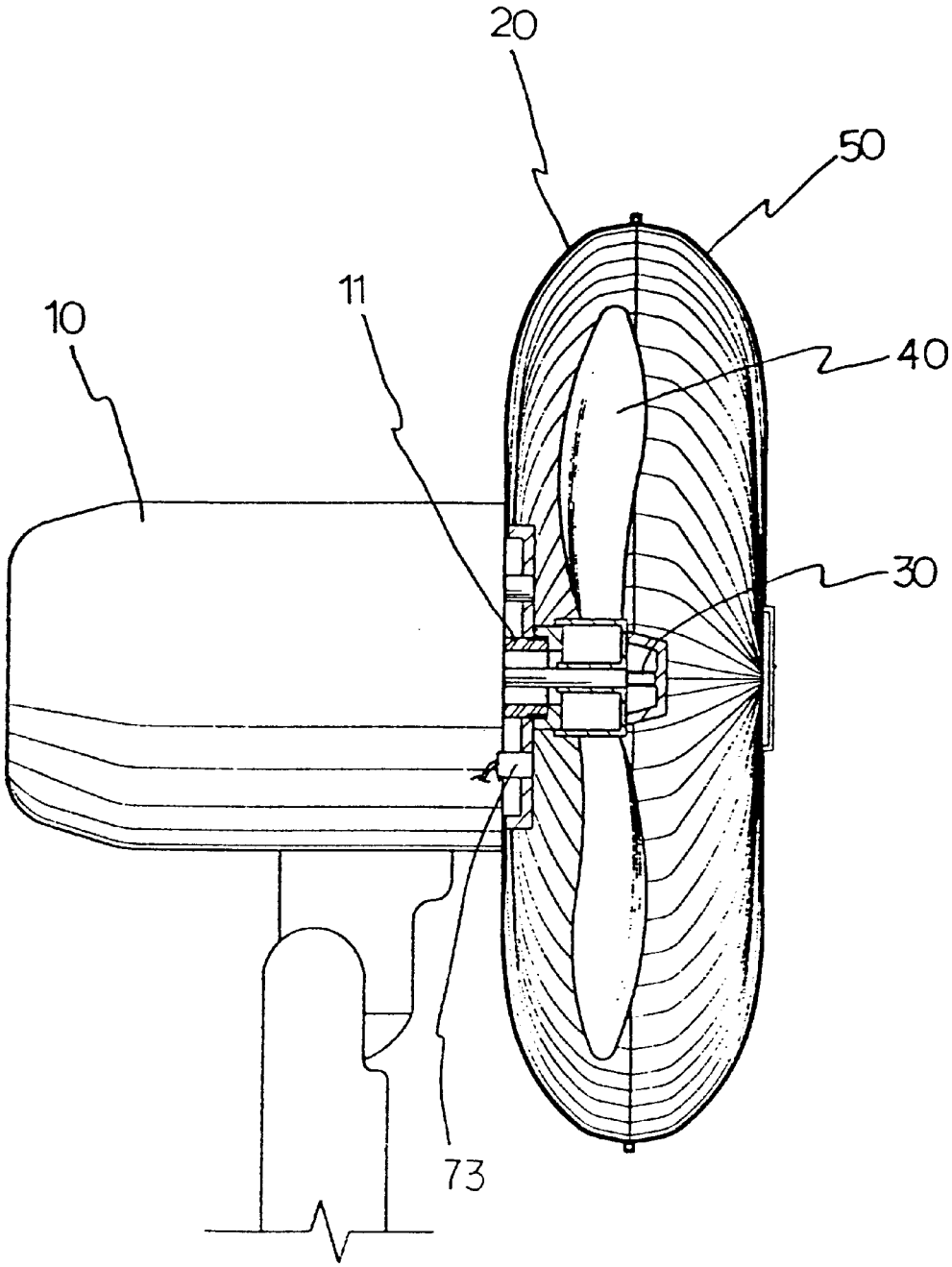
FIG. 2 is a sectional view, showing the construction of the combined fan and heater of this invention when it is used as an electric fan.
Figure 3:
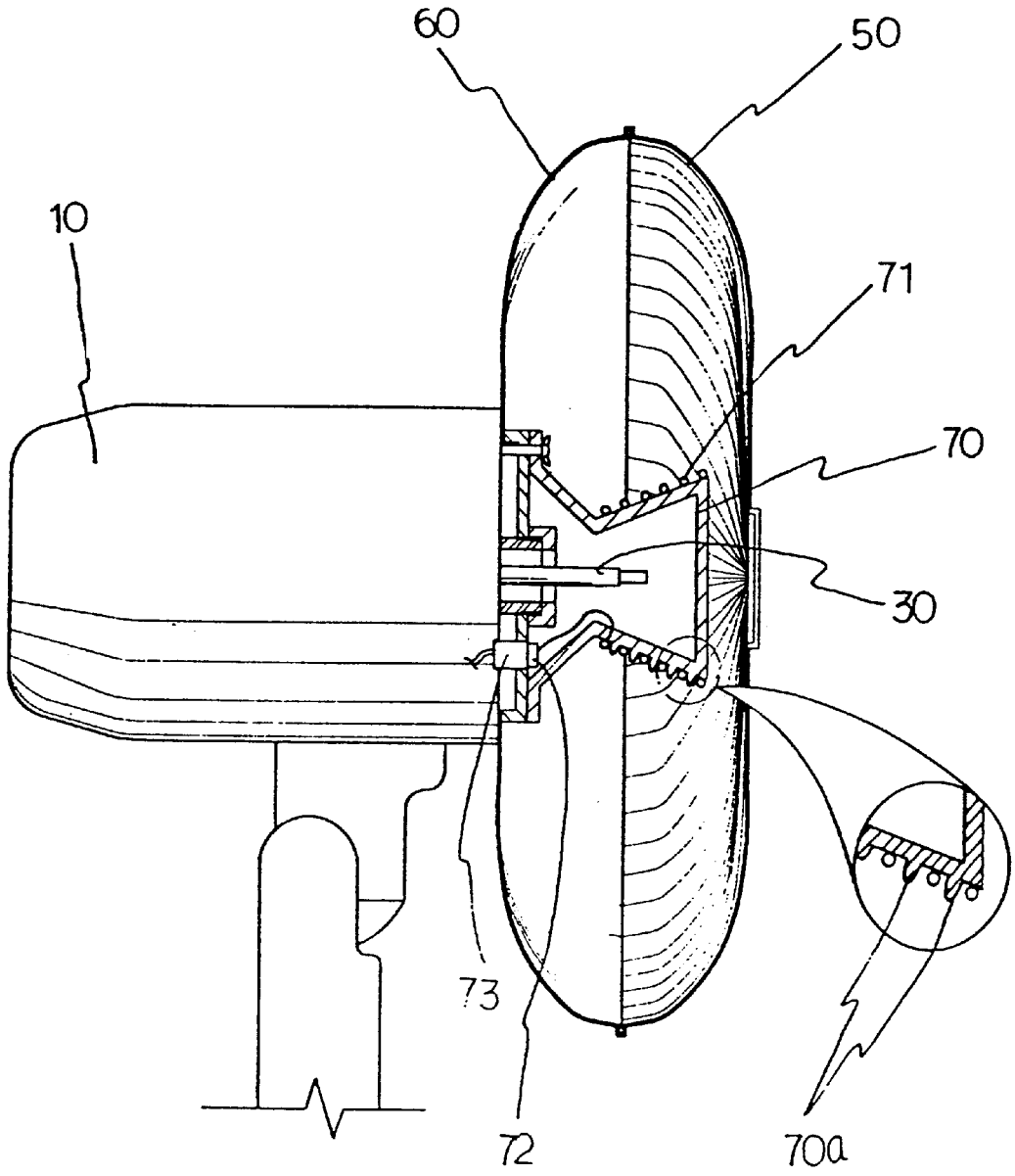
FIG. 3 is a sectional view, showing the construction of the combined fan and heater of this invention when it is used as an electric radiation heater.
Figure 4:
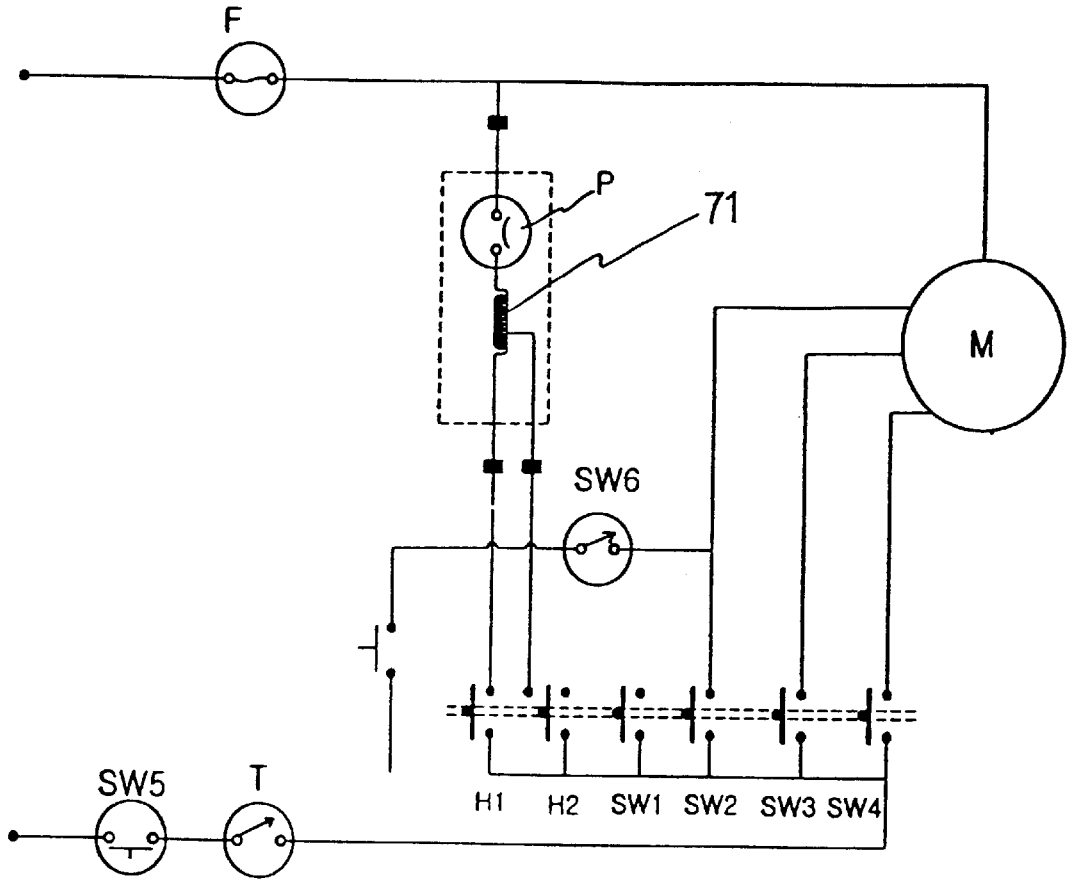
FIG. 4 is a diagram of an electric circuit for the combined fan and heater of this invention.

FIG. 1 is a partially exploded perspective view, showing the construction of a combined fan and heater in accordance with the preferred embodiment of this invention. FIG. 2 is a sectional view, showing the construction of the combined fan and heater when it is used as an electric fan. FIG. 3 is a sectional view, showing the construction of the combined fan and heater when it is used as an electric radiation heater. FIG. 4 is a diagram of an electric circuit for the combined fan and heater.

As shown in FIG. 1, the combined fan and heater of this invention comprises a motor case 10, an externally-threaded boss 11 formed at the front center of the motor case 10. A parabolic rear safety net 20 is detachably held on the boss 11 using an annular nut tightened on the boss 11. A motor shaft 30 projects forward from a motor M, set within the interior of the motor case 10, through the center of the boss 11. A blade unit 40 is detachably held on the motor shaft 30 using a knob nut tightened on the externally-threaded end portion of the motor shaft 30. A parabolic front safety net 50 is assembled with the rear safety net 20 at their edges so as to form a safety net assembly incasing the blade unit 40. The above-mentioned construction of the combined fan and heater remains the same as that of a conventional electric fan. The combined fan and heater is also provided with a parabolic reflector 60, which is designed to be detachably attached to the front end surface of the motor case 10 using a nut while replacing the rear safety net 20. The combined fan and heater further comprises a heat radiating body 70. This heat radiating body 70 is externally wound with a heating coil 71 and is designed to be detachably held on a seat 61 of the parabolic reflector 60 and to be attached to the front end surface of the motor case 10 using a plurality of locking screws while replacing the blade unit 40. In such a case, the heating coil 71 is operated in conjunction with an existing electric circuit. The combined fan and heater of this invention is thus selectively usable as an electric fan and an electric radiation heater.

When it is desired to use the combined fan and heater as an electric fan, the rear safety net 20 is held on the externally-threaded boss 11 formed at the front center of the motor case 10, using the annular nut as shown in FIG. 2. In addition, the blade unit 40 is held on the motor shaft 30, projecting forward from the motor M within the motor case 10 through the center of the boss 11, using the knob nut. Thereafter, the front safety net 50 is assembled with the rear safety net 20 at their edges, thus forming a safety net assembly incasing the blade unit 40.

The shape and size of the parabolic reflector 60 are similar to those of the rear safety net 20 as best seen in FIG. 1, and so the parabolic reflector 60 is easily attached to the front end surface of the motor case 10 using the nut while replacing the rear safety net 20. In the present invention, it is preferable to design the parabolic reflector 60 in a way such that the reflector 60 is able to concentratively reflect heat from the heat radiating body 70 in a desired direction, thus allowing strong heat to effectively reach an area considerably remote from the heater even though the heat reflecting angle of the reflector 60 is somewhat limited.

On the other hand, the front edge of the motor case 10 and the seat 61 of the parabolic reflector 60 are individually provided with a plurality of screw holes, thus allowing the heat radiating body 70 to be attached to the front end surface of the motor case 10 using a plurality of locking screws. The seat 61 of the reflector 60 is provided with a central opening for allowing the boss 11 to pass through.

The heat radiating body 70 is made of a ceramic material and has a double-headed drum shape. This heat radiating body 70 is provided with a plurality of screw holes on its end surface opposed to the front end surface of the motor case 10. The heating coil 71 is regularly wound around the inclined external surface of the heat radiating body 70 at a portion opposite to the end surface having the screw holes. Therefore, the heating coil 71 emits heat to the parabolic reflector 60. The end of the above heating coil 71 extends to the outside of the end surface of the heat radiating body 70 having the screw holes, and is connected to a connector 72. This connector 72 is detachably coupled to another connector 73, set on the front end surface of the motor case 10, thus supplying electricity to the heating coil.

When it is desired to use the combined fan and heater as an electric fan, all the desired parts of the fan are firmly attached to the motor case 10 as described above in conjunction with FIG. 2. After assembling the parts of the fan with the motor case 10, the fan is appropriately operated by manipulating desired function switches provided on the top surface of the base 80. As shown in FIG. 1, the above base 80 is provided with a timer T, a stop switch SW1 and a plurality of wind force control switches SW2, SW3 and SW4, thus allowing a user to easily and conveniently operate the fan.

On the other hand, when it is desired to use the combined fan and heater as an electric radiation heater, the front safety net 50, the blade unit 40 and the rear safety net 20 are orderly removed from the motor case 10. Thereafter, the parabolic reflector 60 in place of the rear safety net 20 is mounted to the front end surface of the motor case 10 using a nut. The heat radiating body 70 in place of the blade unit 40 is stably seated in the seat 61 of the reflector 60, with the connector 72 of the heating coil 71 being coupled to the other connector 73 of the motor case 10. Thereafter, the heat radiating body 70 is firmly mounted to the front end surface of the motor case 10 using a plurality of locking screws passing through the screw holes of said body 70. The front safety net 50 is assembled, with the parabolic reflector 60 at their edges, thus forming a safety cover assembly for the heat radiating body 70.

After the desired parts of the heater are completely assembled with the motor case 10, the heater is appropriately operated by manipulating the timer T. the stop switch SW1 and a plurality of heat control switches H1 and H2 provided on the top surface of the base 80.

The operational effect of the combined fan and heater of this invention will be described herein below in conjunction with the circuit diagram of FIG. 4. As shown in the drawing, a safety switch SW5 is connected to the timer T in series. On the other hand, both the fan motor M and the heating coil 71 are designed to be electrically activated under the control of a switch unit, which consists of the heat control switches H1 and H2, the stop switch SW1 and the wind force control switches SW2, SW3 and SW4.

When the combined fan and heater is used as an electric fan, the fan motor M is activated while being controlled in its rotating speed in a three-step control mode, performed by the three wind force control switches SW2, SW3 and SW4. In such a case, the heater part of the circuit is completely free from an operation due to a switching operation of the switch unit.

On the other hand, when the combined fan and heater is used as an electric radiation heater, the heating coil 71 in place of the fan motor M is electrically activated in response to an operation of either heat control switch H1 or H2. The heating coil 71 of the heat radiating body 70 thus emits heat to the parabolic reflector 60.

In FIG. 4, the reference character SW6 denotes a swivel select switch used for allowing the head assembly of the combined fan and heater to swivel in opposite directions within a predetermined angle. On the other hand, the reference characters P and F denote an overheat sensor and a fuse. In the above electric circuit, the fuse F, the safety switch SW5, the time T and the stop switch SW1 are designed to be operable in both the fan mode and the heater mode.

INDUSTRIAL APPLICABILITY

As described above, the combined electric heater and fan of this invention is designed to be selectively used as an electric fan or as an electric radiation heater as desired while easily and simply replacing some parts of the fan with counterparts of the heater. Particularly when the combined electric heater and fan of this invention is used as an electric radiation heater, a parabolic reflector, having a shape similar to a conventional parabolic antenna, is attached to the motor case. It is thus possible to effectively concentrate heat from the heating coil of a heat radiating body, installed at the center of the parabolic reflector, within a range having a heat reflection angle of about 50° without unnecessarily dispersing heat. Due to such a parabolic reflector, the heater accomplishes a desired radiation heating effect, which allows strong heat to effectively reach an area considerably remote from the heater.

The combined fan and heater of this invention is thus effectively and selectively used as an electric fan in summer and as an electric radiation heater in winter. That is, the combined fan and heater of this invention is four-season equipment, which is not necessary to be stored out of season, but is effectively usable all through the year. Particularly when the combined fan and heater is used as an electric radiation heater, the heater accomplishes a desired radiation heating effect, allowing strong heat to effectively reach an area considerably remote from the heater, due to a parabolic reflector. A desirably improved heating effect is thus accomplished.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In an electric fan, comprising a motor case, an externally-threaded boss formed at a front center of said motor case, a parabolic rear safety net detachably held on said boss using an annular nut tightened on said boss, a motor shaft projecting forward from a fan motor within the motor case through the center of said boss, a blade unit detachably held on the motor shaft using a knob nut tightened on said motor shaft, and a parabolic front safety net assembled with the rear safety net at their edges so as to form a safety net assembly covering the blade unit, the improvement comprising:

a parabolic reflector designed to be detachably attached to a front end surface of said motor case using a nut while replacing the rear safety net; and a heat radiating body externally wound with a heating coil and designed to be detachably held on a seat of said parabolic reflector prior to being attached to the front end surface of the motor case using a plurality of locking screws while replacing the blade unit, with the heating coil being operated in conjunction with an existing electric circuit of the fan, whereby the electric fan is selectively usable as an electric radiation heater as desired.

* * * * *